US005526801A

United States Patent [19]

Cooper

[11] Patent Number: 5,526,801

[45] Date of Patent: Jun. 18, 1996

[54] ADJUSTABLE RANGE BOWSIGHT

[76] Inventor: Gary L. Cooper, HC-4, Box 62, Pocahontas, Ark. 72455

[21] Appl. No.: 117,807

[22] Filed: Sep. 8, 1993

[51] Int. Cl.[6] ..... F41G 1/00

[52] U.S. Cl. ..... 124/87; 33/265

[58] Field of Search ..... 124/89, 90, 91, 124/88, 86, 23.1, 24.1, 25.6, 1; 33/265

[56] References Cited

U.S. PATENT DOCUMENTS

| | | | |
|---|---|---|---|
| 2,941,296 | 6/1960 | Grandt | 33/265 |
| 3,084,442 | 4/1963 | Jacobson et al. | 33/265 |
| 3,163,938 | 1/1965 | Reynolds | 33/265 |
| 3,477,130 | 11/1969 | Egan | 33/265 |
| 4,195,414 | 4/1980 | Robinson . | |
| 4,541,179 | 9/1985 | Closson . | |
| 4,553,338 | 11/1985 | LeBeau | 33/265 |
| 4,620,372 | 11/1986 | Goodrich | 33/265 |
| 4,995,166 | 2/1991 | Knemeyer . | |
| 5,025,565 | 6/1991 | Stenerson et al. | 33/265 |
| 5,103,568 | 4/1992 | Canoy . | |

*Primary Examiner*—Eric K. Nicholson
*Assistant Examiner*—Harry C. Kim
*Attorney, Agent, or Firm*—Polster, Lieder, Woodruff & Lucchesi

[57] ABSTRACT

An adjustable sight for an archery bow has a hollow barrel open at at least one end, the barrel having an interior side wall, and a sliding member mounted in the barrel. The barrel is mounted parallel to the long dimension of a bow, and the sliding member projects beyond an open lower end of the barrel. The sliding member has annular channels in it, in which O-rings are mounted that engage an inside surface of the barrel with sufficient force to inhibit unwanted sliding of the plunger but to permit the plunger to be moved manually by the user of the bow, even when the bow is at full draw. The sliding member carries an aiming device, such as an adjustable sighting pin.

12 Claims, 2 Drawing Sheets

ADJUSTABLE RANGE BOWSIGHT

BACKGROUND OF THE INVENTION

In the sport of archery it has long been appreciated that an aiming device attached to the bow allows for more accurate grouping of arrows. It is also common to use multiple aiming pins which are positioned at various heights on the bow to compensate for the effect of gravity when shooting at varying ranges. Thus when a target of greater distance is considered, a lower height aiming pin on the bow is chosen and aligned with the target. With a constantly fixed anchor position of the arrow nock, this effectively cants the bow and arrow to alter the trajectory and cause the arrow to strike the target when launched. As there are infinite distances that targets may be placed, it is impossible to provide a number of fixed aiming pins on the bow so that at any distance one of the fixed aiming pins may be placed on the target exactly where the arrow is desired to impact. There is therefore a need for a sight which has an aiming pin which can be quickly, quietly and easily adjusted in the vertical plane of the bow. These attributes are particularly important as applied to adjustable sights for hunting bows. Adjustment has been achieved in various ways in the past by means of screw, clip, wheel and lever arrangements. All of these have deficiencies in some manner as to desired qualities of quickness, quietness, smoothness, lack of bulk, simplicity, aesthetics, durability and inexpensive manufacture.

One object of this invention is to provide a bowsight with an instantly moveable aiming device in which few parts are utilized.

Another object is to provide a bowsight which is easy to use and adjust.

Another object is to provide a bowsight which is totally quiet in use.

Another object is to provide a bowsight which is extremely durable.

Another object is to provide a bowsight which has means provided to allow the user to select more or less operating pressure.

Another object is to provide a bowsight which is aesthetically pleasing.

Another object is to provide a bowsight which is inexpensive to manufacture.

Other objects will become apparent to those skilled in the art in light of the following description and accompanying drawings.

SUMMARY OF THE INVENTION

In accordance with this invention, generally stated, an adjustable sight for an archery bow is provided which includes a hollow tube or barrel at least one end of which is open. The barrel has an interior side wall. Means are provided for mounting the barrel on the bow. A plunger or sliding member is mounted in the barrel. Aiming means, such as a pin sight, are mounted on the plunger. Resilient means, in the preferred embodiment, O-rings, are compressed between the plunger and the inside wall of the barrel to inhibit unwanted sliding movement but to permit sliding movement in response to the application of force by the user of the sight. In the preferred embodiment, the barrel is slotted lengthwise of the barrel on diametrically opposite sides of the barrel to permit a sighting pin to be mounted intermediate the ends of the plunger and to project through the slots. The O-rings of the preferred embodiment are seated in annular channels on either side, axially, of the sighting pin. A plurality of channels can be provided in the plunger on either side, axially, of the sighting pin, of varying depths, so that the user of the sight can, by mounting the O-rings in channels of different depths, vary the resistance to movement of the plunger, or compensate for wear.

The plunger is provided with a finger grip, which can take the form of a ledge or hook at an end projecting from the barrel, by which the user of the bow can easily move the plunger up and down in the barrel.

Preferably, the barrel and plunger are cylindrical, circular in transverse cross section. However, they can be made of square tubing, which is readily commercially available, and the plunger can be grooved in such a way as to permit an O-ring, seated in the groove, to extend laterally outwardly from the flat surfaces of the plunger, into contact with the inner wall of the square barrel. Other means for restraining the sliding movement of the plunger can be employed, such as a form of hairpin spring, but the O-ring arrangement has been found to be superior, resisting the vibrational forces that are always present when a bow string is released, and providing smooth and silent movement of the plunger in response to the application of manual force by the user.

DRAWINGS

DESCRIPTION OF THE PREFERRED EMBODIMENT

Figure 1:
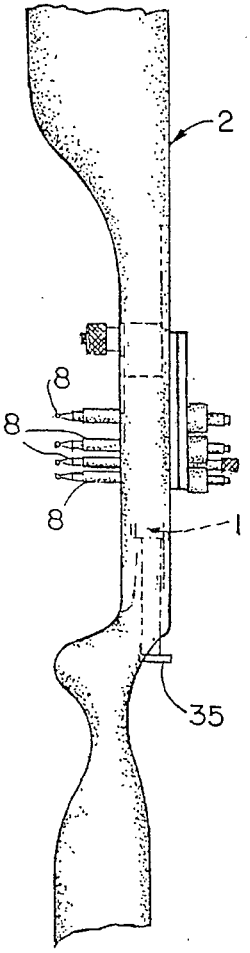
FIG. 1 is a view in rear elevation of a bow equipped with an adjustable sight of this invention.
Figure 2:
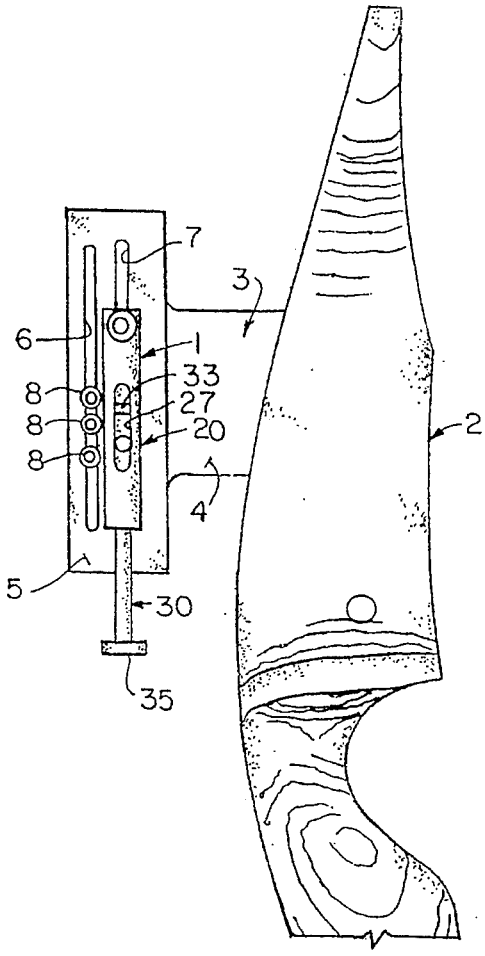
FIG. 2 is a view in side elevation of the device shown in FIG. 1.
Figure 3:
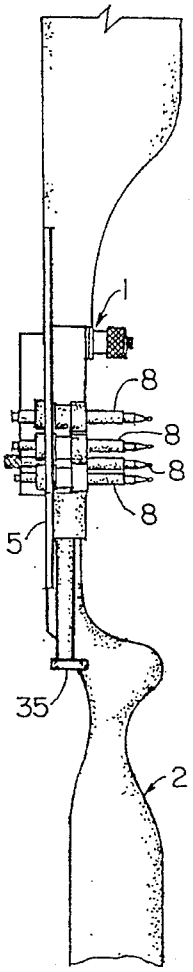
FIG. 3 is a view in front elevation.
Figure 7:
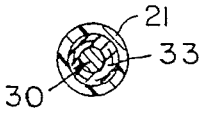
FIG. 7 is a sectional view taken along the line 7—7 of FIG. 4.

Referring now to FIGS. 1–5 and 7 of the drawings for one illustrative embodiment of this invention, an adjustable sight 1 is shown as mounted on a bracket 3 mounted on an archer's bow 2. Modern bows are provided with means for mounting a sighting bracket, although many of the commercially available sighting brackets are more complicated than the simple bracket shown in FIGS. 1 through 3, but the bracket 3 can be adapted to be mounted on any conventional modern bow, and the means for such mounting form no part of this invention. Examples of more complicated brackets are shown in U.S. Pat. Nos. 4,541,179, 4,195,414, and 4,995,166. In the illustrative embodiment shown in this case, the bracket 3 has an arm 4 fastened to the bow, and a plate 5 connected to the arm and extending forward of the bow. The plate 5 is elongated vertically (in the long direction of the bow), and equipped with two, parallel, vertically extending slots 6 and 7. Standard sighting pins 8 are mounted on the the plate 5 through the slot 6.

The sight 1 is shown as being mounted to the plate 5 by means of a knurled nut 11 threadedly mounted on a shaft 12 that passes through the slot 7 and is mounted on the opposite side of the plate 5 in a nut or head 13.

Figure 5:
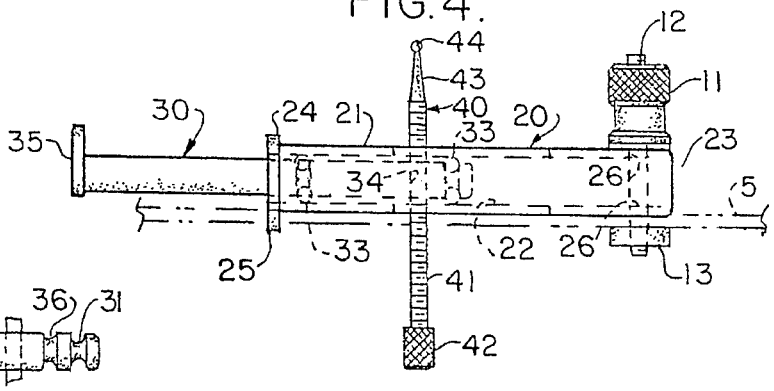
FIG. 5 is a view of the sight shown in FIG. 4, in side elevation.

The sight 1 includes a barrel 20, a plunger 30, and a sighting pin 40. The barrel 20 is cylindrical, circular in transverse cross section, and elongated. The barrel 20 has a cylindrical side wall 21 with an inner surface 22. In this embodiment, an upper end of the barrel is closed by a top wall 23. Its lower end is open, and is surrounded by a flange 24, cut away at an edge contiguous the plate 5 to form a tab 25 that extends through the slot 7 when the barrel is mounted, as shown in FIG. 5. Areas of the flange on either side of the tab 25 are flat along their bottom edge, so as to rest flat against the plate 5. A pair of diametrically aligned holes 26, axially close to the upper wall 23, receive the shaft 12. Slots 27 in the wall 21 extend lengthwise parallel with the slot 7, and diametrically aligned with the holes 26. The slots 27 are of a length to accomodate the desired range of movement of the sighting pin 40.

Figure 4:
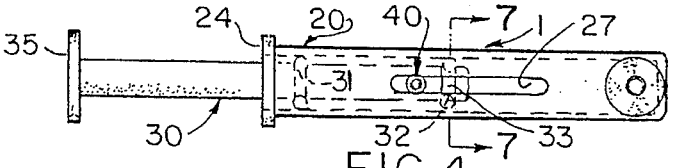
FIG. 4 is a somewhat enlarged detail view of the preferred embodiment of adjustable sight of this invention in front elevation.
Figure 8:
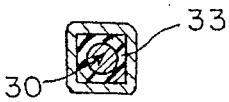
FIG. 8 is a sectional view corresponding to the view in FIG. 7 of another embodiment in which a barrel and plunger are square in transverse cross-section.

The plunger 30 is also cylindrical, circular in transverse section. In the embodiment shown, the plunger is solid, but it can be made tubular, if desired. As illustrated in FIGS. 4 and 5, the plunger is provided with a lower annular channel 31 and an upper annular channel 32. O-rings 33 are mounted in the channels 31 and 32. The plunger has a diametrically extending internally threaded passage 34, through which the sighting pin 40 is threaded to project, as shown particularly in FIG. 5. If the plunger 30 is made hollow, there are, of course, two passages through the wall of the cylinder. At the bottom end of the plunger 30, a finger-engagable ledge or shelf 35 is provided to facilitate the pulling of the plunger in a direction downwardly from the barrel 20 and pushing it up. The sighting pin 40, which has a threaded shank 41, a knurled end 42 and a tapered sighting end 43 with a sight ball 44 on it, extends through the slots 27, the threaded shank 41 being screwed through the passage 34 until the ball 44 is suitably aligned with the similar ends of the sighting pins 8. The shanks of the pins 40 and 8 are parallel.

In the absence of the O-rings 33, the plunger 30 fits loosely within the barrel 20. The O-rings 33 provide an effective length of bearing surface, and engage the inner surface 22 of the barrel snugly enough to inhibit unwanted movement of the plunger with respect to the barrel, even in face of the vibration attendant the release of the bow string. At the same time, they permit movement, by the finger of the user, which is smooth and silent.

Figure 6:
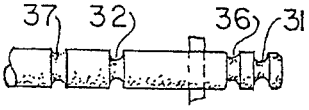
FIG. 6 is a fragmentary view in side elevation of a plunger equipped with a plurality of channels or grooves of different depths.

The embodiment of plunger shown in FIG. 6 is provided with channels 36 and 37, parallel to but shallower than channels 31 and 32. O-rings of the same size as O-rings 33, seated in channels 36 and 37 will bear more forcefully against the inside surface 22 of the barrel wall 21, and therefore provide more resistance to movement. The grooves 36 and 37 can be used either to provide greater resistance to movement or, if the O-rings 33 wear after they have been in the grooves 31 and 32, they can be moved to grooves 36 and 37 to provide the same amount of resistance as the O-rings 33 did initially. In the arrangement shown in FIG. 6, the channels 36 and 37 are spaced axially from one another the same distance as the channels 31 and 32. Other arrangements of these channels can be made, and they can be placed close together, the distances between the channels 32 and 37 and the channels 31 and 36 in FIG. 6 being exaggerated for clarity.

Instead of a single ledge, double ledges or fingers or a loop may be provided, to facilitate the plunger's being pushed or pulled by the forefinger of the bow hand while at full draw to select the proper height of the sighting pin 40.

Figure 9:
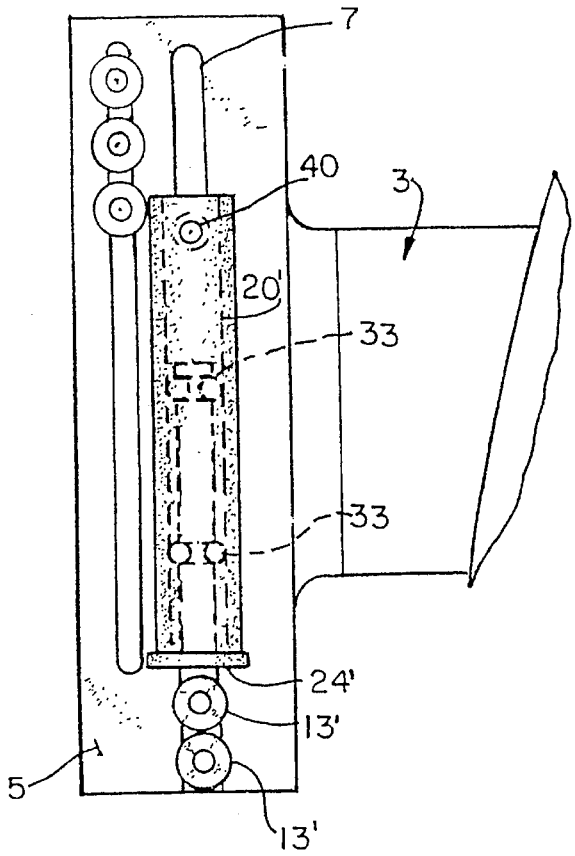
FIG. 9 is a view in side elevation of an adjustable sight of this invention.
Figure 10:
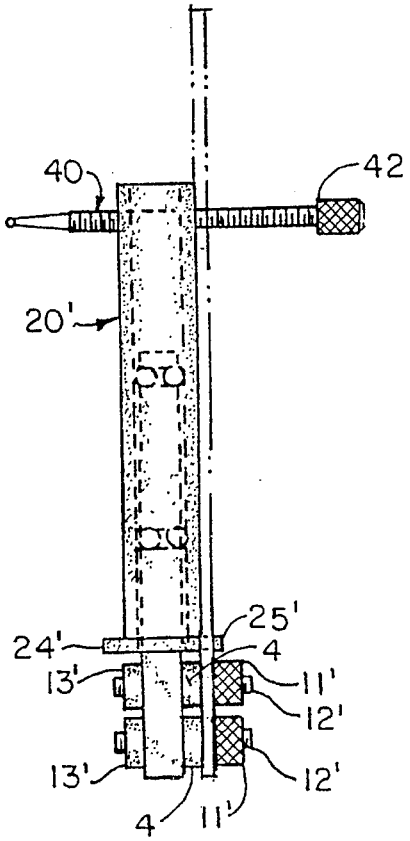
FIG. 10 is a view in front elevation of the device shown in FIG. 9.

Numerous variations in the construction of the device of this invention, within the scope of the appended claims, will occur to those skilled in the art in the light of the foregoing disclosure. Merely by way of example, and not of limitation, different radially compressive devices can be used to accomplish what is, in the preferred embodiment, accomplished by the O-rings. For example, a sleeve of rubber-like material, can be put on the plunger, provided with ribs to engage the inside surface of the barrel. The outside cylindrical surface of the plunger can be made uninterrupted, and the inside surface of the barrel provided with channels to receive O-rings. The inside surface of the barrel may be lubricated, or made of some particularly slick material. A separate sleeve, between the surface of the plunger and the inside surface of the barrel can be provided to increase the amount of friction, or simply to provide a guide for the plunger below the O-ring or other resilient material. The barrel and plunger can be made in other non-circular shapes, as, for example, polygonal or oval. The top wall of the barrel can be a separate closure piece, in the form of a cap, which may have a vent hole through it, or the like. Although, as has been explained heretofore, it is by no means the preferred embodiment, other means, such a modified hairpin type spring, can be employed. If a relatively short barrel, particularly a non-circular one, is used, the plunger can extend from the upper end of the barrel, and the sighting pin can be mounted on the upper end of the plunger, in which case, a boss on one side of the barrel, or an external mounting sleeve or the like would have to be used to mount the barrel on the mounting plate. This would eliminate the need for slots in the barrel, but would not protect the plunger as well as the device of the preferred embodiment. As illustrated in FIGS. 9 and 10, in which primes are used to designate corresponding parts, the functions of the barrel and plunger can be reversed, by mounting the plunger on the bow sight bracket by means of mounting pins, a mounting arm or the like, bushed or otherwise provided with a spacer 4 to hold the plunger spaced from the bracket far enough to clear the barrel, and the sight pin can then be carried by the barrel. The barrel can be provided with a slot opening through its lower edge, aligned and configured to permit a lower part of the barrel to straddle the mounting means, to permit longer travel of the barrel, if desired. A depending skirt or extension of the barrel can be provided with the means for facilitating moving the barrel up and down with respect to the plunger. These are merely illustrative.

I claim:

1. An adjustable sight for an archery bow, comprising a hollow barrel open at at least one end, said barrel having a long axis and an interior side wall, means for mounting said barrel on said bow with the long axis of the barrel oriented in a direction parallel to a long dimension of said bow, a sliding plunger member mounted in said barrel, means resiliently compressed between said sliding plunger member and said interior side wall for inhibiting sliding movement but for permitting sliding movement of said sliding plunger member in response to the application of manual force to said sliding plunger member in a direction generally parallel to said long axis of said barrel by the user of said sight, and sighting pin means carried by said sliding plunger member.

2. The adjustable sight of claim 1 wherein said barrel has parallel diametrically opposite slots in a barrel side wall, and said sighting pin means comprises a sighting pin extending through said sliding plunger member and through said slots.

3. The adjustable sight of claim 1 wherein said resiliently compressed means are mounted on said sliding plunger member.

4. The adjustable sight of claim 1 wherein said resiliently compressed means are O-rings.

5. The adjustable sight of claim 3 wherein said resiliently compressed means are O-rings.

6. An adjustable sight for an archery bow, comprising a hollow barrel open at at least one end, said barrel having a long axis and an interior side wall, means for mounting said barrel on said bow with the long axis of the barrel oriented in a direction parallel long dimension of said bow, a sliding plunger member mounted in said barrel, means resiliently compressed between said sliding plunger member and said interior side wall for inhibiting sliding movement but for permitting sliding movement of said sliding plunger member in response to the application of manual force to said sliding plunger member in a direction generally parallel to said long axis of said barrel by the user of said sight, and sighting pin means carried by said sliding plunger member, said sliding plunger member projecting from a bottom end of said barrel, and said sliding plunger member being provided at its lower end with finger engagable means for facilitating movement of said sliding plunger member by the fingers of the user of the bow.

7. The adjustable sight of claim 1 wherein the sliding plunger member is a hollow tube.

8. The adjustable sight of claim 1 wherein the barrel is cylindrical and circular in transverse cross section.

9. The adjustable sight of claim 1 wherein the barrel and sliding plunger member are non-circular in transverse cross section.

10. The adjustable sight of claim 9 wherein the barrel and sliding plunger member are square in transverse cross section.

11. The adjustable sight of claim 1 wherein the sliding plunger member is provided with annular channels and O-rings are mounted in said channels, and additional channels of different depths are provided in which said O-rings can alternatively be mounted.

12. An adjustable sight for an archery bow, comprising a plunger and a barrel, at least one O-ring mounted between said plunger and said barrel and engaging facing surfaces of both, means for mounting one of said barrel and plunger on said bow, while permitting the other of said plunger and barrel to be moved axially with respect to the mounted one of said plunger and barrel, a sighting pin mounted on said movable one of said plunger and barrel, and finger engagable means at a lower end of said movable one of said plunger and barrel for facilitating movement of said movable one of said plunger and barrel by the fingers of a user of the bow.

* * * * *